United States Patent [19]

Reiling et al.

[11] Patent Number: 5,031,362

[45] Date of Patent: Jul. 16, 1991

[54] GRINDING ATTACHMENT FOR A HAND-HELD POWER-OPERABLE ROTARY TOOL

[76] Inventors: Reinhold Reiling; Karl Reiling, both of Remchinger Strasse 4, D-7535 Königsbach-Stein, Fed. Rep. of Germany

[21] Appl. No.: 546,515

[22] Filed: Jun. 29, 1990

[30] Foreign Application Priority Data

Jul. 13, 1989 [DE] Fed. Rep. of Germany ... 8908547[U]

[51] Int. Cl.[5] ..... B24B 23/06

[52] U.S. Cl. ..... 51/170 EB

[58] Field of Search ..... 51/170 R, 170 ED, 135 R, 51/135 BT

[56] References Cited

U.S. PATENT DOCUMENTS 3,611,646 10/1971 Cameron et al. ..... 51/170 EB
3,643,385 2/1972 Mikiya ..... 51/170 EB
4,578,906 4/1986 appleton ..... 51/170 EB
4,858,390 8/1989 Kenig ..... 51/170 EB

FOREIGN PATENT DOCUMENTS 145264 6/1985 European Pat. Off. ..... 51/170 EB

*Primary Examiner*—Roscoe V. Parker
*Attorney, Agent, or Firm*—Dvorak and Traub

[57] ABSTRACT

A grinding attachment is provided for a hand-held power-operable rotary tool, which may consist of a hand-held drilling machine or a hand-held angular surface grinder. The grinding attachment comprises a drive pulley, a reversing pulley, an endless grinding belt trained around said pulleys, and a belt-tensioning finger extending between said pulleys. The reversing pulley has a slightly sloping peripheral surface and is rotatably mounted in a U-shaped bracket, which is axially extensible by means of a spring-biased push rod and in its peripheral surface is provided with a centrally disposed annular groove, which prevents a slipping of the grinding belt trained around the reversing pulley.

5 Claims, 1 Drawing Sheet

GRINDING ATTACHMENT FOR A HAND-HELD POWER-OPERABLE ROTARY TOOL

BACKGROUND OF THE INVENTION

1. Field of the Invention

This invention relates to a grinding attachment for a hand-held power-operable rotary tool, which may consist of a hand-held drilling machine or a hand-held angular surface grinder, which grinding attachment comprises a drive pulley, a reversing pulley, an endless grinding belt trained around said pulleys, and a belt-tensioning finger extending between said pulleys.

2. Description of the Prior Art

Such grinding attachments are known from German Utility model 85 34 371. In that known grinding attachment the lateral guidance of the grinding belt and of the reversing pulley and the adjustment and tensioning of the grinding belt cannot reliably be effected.

SUMMARY OF THE INVENTION

It is an object of the invention to provide a grinding attachment which is of the kind described first hereinbefore and in which the disadvantages mentioned above and other disadvantages are avoided.

In a grinding attachment of the kind described first hereinbefore that object is accomplished in that the reversing pulley has a slightly sloping peripheral surface and is rotatably mounted in a U-shaped bracket, which is axially extensible by means of a spring-biased push rod and in its peripheral surface is provided with a centrally disposed annular groove, which prevents a slipping of the grinding belt trained around the reversing pulley.

The spring-biased push rod may consist of a square rod having chambered side faces and may be slidably mounted in a mating guiding aperture formed in the body of the tensioning finger, which on opposite sides of said guiding aperture if formed with respective guide slots, in which a screw assembly is guided, which comprises at one end a screw head, which is guided on one side of the finger body and extends into one of said guide slots, and at the other end is provided with a nut, which is fixed to the screw and guided on the other side of said finger body. The screw is in threaded engagement with a tapped bore of the push rod and can be rotated to axially adjust the U-shaped bracket and the reversing pulley in adaptation to the grinding belt as it revolves.

DETAILED DESCRIPTION OF THE PREFERRED EMBODIMENT

Figures 1, 2, 3:
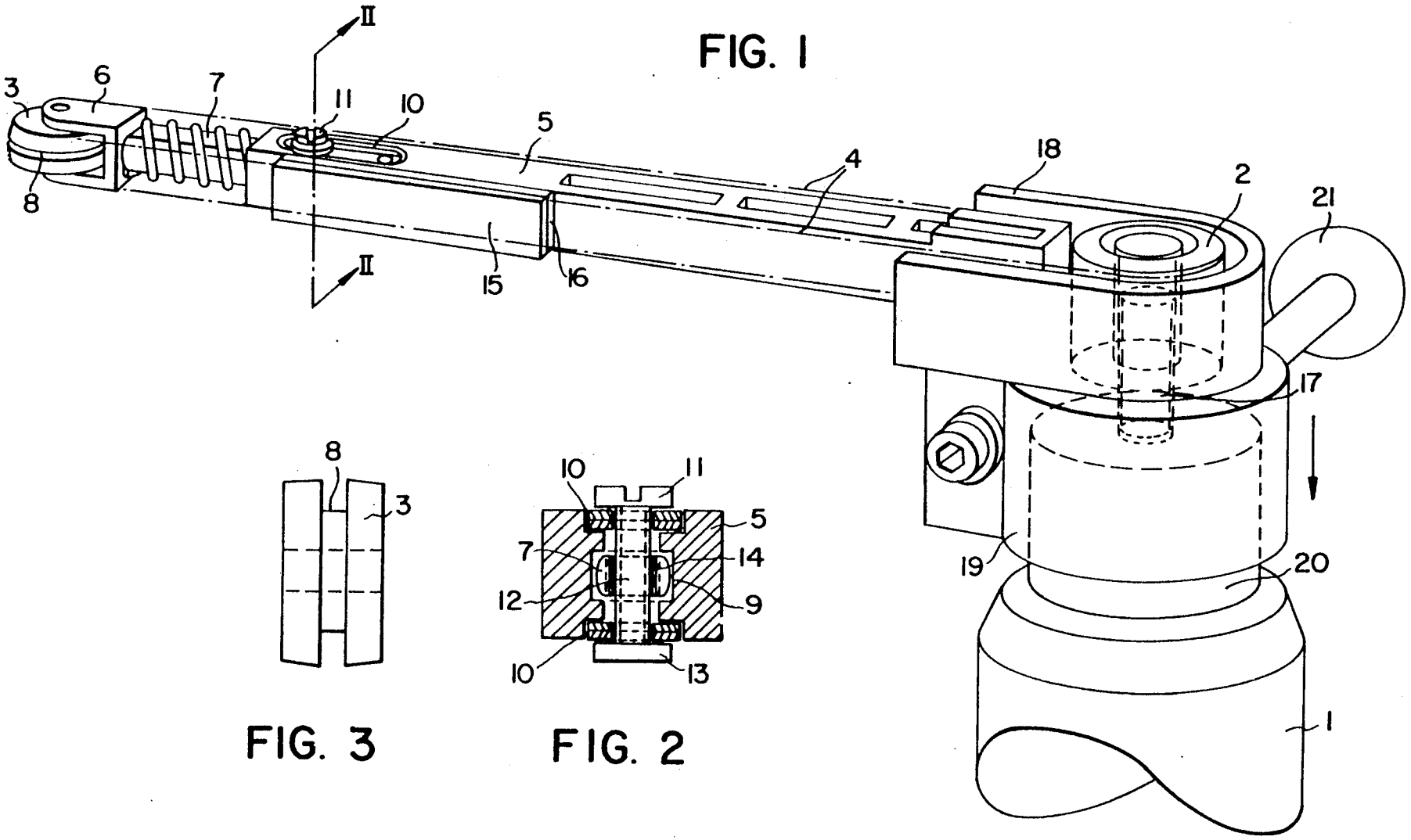
FIG. 1 is a perspective view showing a grinding attachment embodying the invention.
FIG. 2 is a sectional view taken on line II—II in FIG. 1.
FIG. 3 is an elevation showing the reversing pulley.

Further details will now be described with reference to a preferred embodiment of a grinding attachment embodying the invention which is shown on the drawing.

The grinding attachment shown on the drawing is intended for mounting on a housing member 1 of a hand-held drilling machine or a hand-held angular surface grinder and comprises a drive pulley 2, a reversing pulley 3, an endless grinding belt 4, which is trained around the pulleys 2 and 3, and a tensioning finger having a body 5, which extends between the pulleys 2 and 3. The reversing pulley 3 is rotatably mounted in a U-shaped bracket 6 and is axially movable by a spring-biased push rod 7. The peripheral surface of the reversing pulley slightly slopes toward both sides and is formed with a centrally disposed annular groove 8, which prevents a slipping of the revolving grinding belt 4 from the reversing pulley 3.

The spring-biased push rod 7 consists of a square rod having cambered side faces and is slidably mounted in a guiding aperture 9, which is formed in the body 5 of the tensioning finger. On opposite sides of the guiding aperture 9 the finger body 5 is formed with respective guide slots 10. A screw assembly is provided, which comprises a screw 12, which is in threaded engagement with a tapped transverse bore 14 of the push rod 7 and is provided at one end with a screw head 11 that is guided on one side of the finger body 5 and at its other end with an axially fixed nut 13, which is guided on the other side of the push rod 7. By a rotation of the screw 12 the push rod 7 can laterally be adjusted for an adaptation of the U-shaped bracket 6 and the reversing pulley 3 to the revolving grinding belt 4.

A compression spring is coiled around the push rod 7 between the finger body 5 and the U-shaped bracket 6 and urges the bracket 6 away from the finger body 5 to extend the push rod 7.

The finger body 5 is provided at least on one side with a metal strip 15 and an underlying layer 16 of rubber or another elastomer and is in sliding contact with the grinding belt 4. The drive pulley 9 consists of rubber or another elastomer and is adapted to be screwed on screw threads provided on the free end portion of an output shaft 17 of the hand-held drilling machine 1 or a hand-held angular surface grinder.

A U-shaped hand guard 18 extends around a part of the periphery of the drive pulley 2 and is fixed to a split collar 19, which is adapted to be clamped on a neck 20 of the hand-held drilling machine or angular surface grinder and is provided with a laterally protruding knob 21.

In the illustrated embodiment the drive pulley 2 and the reversing pulley 3 are laterally spaced apart. The tensioning finger for tensioning the grinding belt 4 comprises a finger body 5 extending between the pulleys 2 and 3, a push rod 7, which is longitudinally slidably mounted in the finger body 5 and has an outer end portion protruding from the finger body 5 opposite to the drive pulley 2, a U-shaped bracket 6, which is fixed to the outer end portion of the push rod 7 and in which the reversing pulley is rotatably mounted, and spring means urging said U-shaped bracket 6 and said finger body 5 apart.

The finger body 5 is formed with a longitudinally extending guiding aperture 9, in which said square rod 7 is slidably mounted. The finger body 5 is formed on opposite sides of said guiding aperture 9 with respective longitudinally extending guide slots 10. The push rod 7 is formed in the finger body 5 with a transverse tapped bore 14. A screw assembly comprises a screw 12, which is in threaded engagement with the tapped bore 14 and is provided at opposite ends with enlarged end portions, which are guided in the slots 10. One of said enlarged end portions comprises a head 11 at one end of the screw 12. The other of said enlarged end portions comprises a nut 13, which is axially fixed to the screw 12.

Each of said enlarged end portions comprises washer means surrounding the screw 12 and extending in one of the slots 10. The screw head 11 is operable to rotate the screw 12 for axially adjusting the reversing pulley 3.

We claim:

1. In a grinding attachment for use on a hand-held power-operable rotary tool, comprising a drive pulley, a reversing pulley laterally spaced from said drive pulley, a grinding belt trained around said pulleys, and a tensioning finger extending between said pulleys and adapted to tension said belt, the improvment residing in that said tensioning finger comprises a finger body extending between said pulleys, a push rod, which is longitudinally slidably mounted in said finger body and has an outer end portion protruding from said finger body opposite to said drive pulley, a U-shaped bracket, which is fixed to said outer end portion of said push rod and in which said reversing pulley is rotatably mounted, and spring means urging said U-shaped bracket and said finger body apart, and said reversing pulley has a peripheral surface which slopes toward both sides and is formed with a centrally disposed annular groove for restraining said grinding belt against a lateral slipping from said reversing pulley, wherein said push rod is a square rod, which has cambered side faces, said finger body is formed with a longitudinally extending guiding aperture, in which said square rod is slidably mounted, said finger body is formed on opposite sides of said guiding aperture with respective longitudinally extending guide slots, said push rod is formed in said finger body with a transverse tapped bore, a screw assembly is in threaded engagement with said tapped bore and is provided at opposite ends with enlarged end portions, which are guided in said slots, and one of said end portions is operable to rotate said screw assembly for axially adjusting said reversing pulley.

2. The improvement set forth in claim 1, wherein said screw assembly comprises a screw in threaded engagement with said tapped bore, one of said enlarged end portions comprises a head at one end of said screw and the other of said enlarged end portions comprises a nut, which is axially fixed to said screw.

3. The improvement set forth in claim 1, wherein each of said enlarged end portions comprises washer means surrounding said screw and extending in one of said slots.

4. The improvement set forth in claim 1, wherein said finger body is provided at least on one side with a fixed metal strip for sliding contact with said grinding belt and with an elastomeric underlayer underlying said metal strip.

5. The improvement set forth in claim 1 as applied to a grinding attachment for use on a hand-held power-operable rotary tool having a neck, wherein said grinding attachment comprises a U-shaped hand guard extending around a part of the periphery of said drive pulley and a split collar, which is fixed to said hand guard and is adapted to be clamped on said neck and provided with a laterally protruding knob.

* * * * *